US008991083B1

(12) United States Patent
Pohlman, Jr.

(10) Patent No.: US 8,991,083 B1
(45) Date of Patent: Mar. 31, 2015

(54) CUBE PICTURE DISPLAY SYSTEM WITH BASE OPENINGS

(71) Applicant: Robert L Pohlman, Jr., Lynn Haven, FL (US)

(72) Inventor: Robert L Pohlman, Jr., Lynn Haven, FL (US)

( * ) Notice: Subject to any disclaimer, the term of this patent is extended or adjusted under 35 U.S.C. 154(b) by 0 days.

(21) Appl. No.: 14/549,524

(22) Filed: Nov. 20, 2014

(51) Int. Cl.

| | |
|---|---|
| ***G09F 7/04*** | (2006.01) |
| ***G09F 9/00*** | (2006.01) |
| ***G09F 15/00*** | (2006.01) |
| ***A63F 9/12*** | (2006.01) |

(52) U.S. Cl.
CPC .. *G09F 9/00* (2013.01); *G09F 7/04* (2013.01); *G09F 15/0068* (2013.01); *A63F 9/1204* (2013.01); *A63F 2009/1212* (2013.01)
USPC ..... 40/600

(58) Field of Classification Search
CPC ..... G09F 7/04; G09F 15/0068; A63F 9/1204; A63F 2009/1212
See application file for complete search history.

(56) References Cited

U.S. PATENT DOCUMENTS

| | | | | |
|---|---|---|---|---|
| 3,464,145 | A * | 9/1969 | Martin | 446/118 |
| 4,021,939 | A * | 5/1977 | May | 434/403 |
| 4,307,886 | A * | 12/1981 | Kemper | 273/239 |
| 4,741,534 | A * | 5/1988 | Rogahn | 273/157 R |
| 5,487,668 | A * | 1/1996 | Oyen et al. | 434/98 |
| 5,785,319 | A * | 7/1998 | Frauhiger | 273/157 R |
| 6,422,560 | B1 * | 7/2002 | Harbaugh | 273/157 R |
| 2003/0046845 | A1 * | 3/2003 | Boddie | 40/600 |
| 2009/0193629 | A1 * | 8/2009 | Suenaga | 24/303 |

* cited by examiner

*Primary Examiner* — Gary Hoge
(74) *Attorney, Agent, or Firm* — Peter Loffler

(57) ABSTRACT

A cube display system uses a frame with upstanding outer periphery side walls. A series of uniform sized cubes has a portion of an overall picture on each face. The cubes are placed into the inner space of the frame in an appropriate position, with the appropriate face facing upwardly and properly oriented. When all of the cubes are so placed, the overall picture is displayed. Different pictures are formed when displaying different faces of the cubes. An opening is located underneath each cube such that a finger or a poking tool is inserted through the opening in order to dislodge a particular cube from the cube matrix. The openings are encompassed by a magnetically attractive material and another magnetically attractive material is disposed on each face in order for the cubes and base to magnetically attract each other. Alternately, the frame is a banding frame that cinches the formed matrix.

6 Claims, 3 Drawing Sheets

CUBE PICTURE DISPLAY SYSTEM WITH BASE OPENINGS

This application is a Continuation-In-Part of U.S. patent application Ser. No. 14/327,616 filed on Jul. 10, 2014, which prior application is incorporated herein by reference in its entirety.

BACKGROUND OF THE INVENTION

1. Field of the Invention

The present invention relates to a cube picture display system wherein a series of cubes are magnetically held within a frame to form a matrix such that different pictures are displayed depending on which face of each of the cubes is outwardly facing. The frame has a series of openings within its base to allow individual cubes to be easily extracted from the frame when the display system is fully assembled. Alternately, the frame comprises a band, either rigid or flexible, that encompasses the outer periphery of the formed matrix and cinches the matrix together.

2. Background of the Prior Art

Cube picture display systems are systems whereby a series of cubes are provided such that a portion of an overall picture is displayed on the face of each cube, each face having a different pictorial representation thereon, such that when the cubes are arranged within a frame and the appropriate face of each cube is facing outwardly, for example the first face of each cube, and each cube is oriented and positioned in an appropriate position in a matrix within the frame, an overall coherent picture is displayed by the system. If a different face of each cube is facing outwardly, for example the second face of each cube, then a different picture is displayed by the system. This allows at least six different pictures to be displayed by the system, one picture for each face of the cube, although more than six different pictures can be displayed. For example, if the overall picture is of a human face, then just some of the cubes can be rotated to have a different cube face facing outwardly, for example just the cubes that display the eyes of the face, and a new picture is formed, with the originally displayed human face with a new set of eyes. Similarly, the nose, mouth, ears, etc., can be changed in like manner for different face representations, remembering of course that a total of six different overall faces are also present. Other pictorial representations are also possible that allow partial pictorial changes with the rotation of less than all of the cubes that form the display. Such systems are fun ways to display pictures and are also entertaining as a puzzle system.

My U.S. Pat. No. D414,613, issued on Oct. 5, 1999, shows a six cube by six cube matrix display system, although both larger and small cube matrixes are possible.

One of the challenges of such cube display systems occurs when a picture is fully formed and a user desires to change some or all of the cubes. When the picture is fully assembled, the cube matrix fits snugly within the inner space of the outer periphery frame and it is very difficult to extract an individual cube from the frame, especially if the cubes are relatively tightly packed within the frame. If the user desires only to extract the cubes that form the eyes of a facial picture display, the user may be forced to overturn the frame and dump all of the cubes and rebuild the picture in order to so accomplish. This is undesirable, especially if the cube matrix is relatively large. In a tightly packed cube system, even a simple overturn may not readily release the bounty of cubes from its frame. While a user may use some type of tool to help with cube extraction from the frame, such as a large pair of tweezers or a pair of pliers, such tools may not be readily available, and even if they are, may scratch the cube being extracted or one of the adjacent cubes. The same problem can occur when the picture is only partially formed and the user desires to remove a cube from a tightly packed and fully formed row, as may occur when the user discovers that a cube is in the wrong position.

Additionally, holding the cubes within the frame can also be problematic if the frame is bumped or otherwise jarred or tilted during matrix assembly or when the finished picture is rotated from being substantially horizontal to a more vertical position for display. Bumping the frame during matrix assembly can scramble the cubes about while tilting the frame and matrix to a more vertical or even a fully vertical position can break the matrix requiring a total rebuild.

What is needed is a system whereby a cube can be quickly and easily removed from a fully or partially formed cube picture display system without the need to overturn the frame and dump all the cubes out and without the need to use any type of tool that can damage the picture portion displayed on the cubes and that can holds the cubes in place during puzzle assembly and during puzzle display when the frame and puzzle are rotated toward or to a vertical orientation. Such a system must be relatively quick and easy to use and must not significantly add to the overall complexity of the cube display system either from an operational point of view or a manufacturing point of view.

SUMMARY OF THE INVENTION

The cube display system addresses the aforementioned needs in the art by providing a typical cube display system with means that allow an individual cube to be quickly and easily removed from the system's frame, irrespective of the state of the overall assembly of the cube matrix, without the need to overturn the frame and without the need to employ any type of tool and that holds the cubes in place during matrix assembly and during matrix display when the frame and matrix are rotated toward or to a vertical alignment. An alternate embodiment eliminates the problem of removal of individual cubes from a completed matrix while securely holding the finished matrix when the matrix is moved toward or to a vertical orientation with the added benefit of allowing two sides of the matrix to be viewed at a given time. Each embodiment of the cube display system is relatively simple to use and does not require any significant increase in manufacturing complexity, being produced using standard manufacturing techniques, so as to keep the cube display system relatively inexpensive to produce so as to be economically attractive to potential consumers for this type of device.

The cube display system of the present invention is comprised of a base that has a series of openings that have a first magnetically attractive material encompassing each opening. A peripheral frame extends upwardly from the base. The frame has a top edge having a top inside surface, a bottom edge having a bottom inside surface facing the top edge, a left edge having a left inside surface joining the top inside surface and the bottom inside surface, and a right edge having a right inside surface opposite the left inside surface and joining the top inside surface and the bottom inside surface. The top inside surface, the left inside surface, the bottom inside surface, and the right inside surface form an inner space that is rectangular in shape. A series of equal sized cubes are provided such that each cube has twelve side edges all of equal width and each cube has six faces. A second magnetically attractive material is disposed within each face of each cube. Each of the series of cubes is placed into the inner space of the frame in order to form a matrix such that when the matrix is so formed a respective one of the series of openings is located underneath each cube and the first magnetically attractive material and the second magnetically attractive material magnetically align and, if appropriately pole oriented, magnetically attract—the first magnetically attractive material and the second magnetically attractive material repel if each is a magnet and each is of the same pole orientation, indicating that at least one of the cubes is improperly positioned. The top inside surface (or bottom inside surface) of the frame has a first length that is equal to a first integer multiple of the width of a cube and the left inside surface (or right inside surface) of the frame has a second length that is equal to a second integer multiple of the width of the cube, the two integer multiples may or not be the same. Each face of each of the cubes has a portion of a pictorial representation (six different portions of pictorial representations on each cube) such that when the matrix is formed, the upwardly facing face of each cube forms a planar surface with the multiple pictorial representations revealing a completed and continuous picture.

At least six different coherent pictures can be displayed (of course substantially more pictures can be formed if the cubes are in the wrong position, have the improper face facing upwardly for a given picture, or are oriented improperly, such pictures not necessarily being coherent), but if the picture is formed properly, then a minimum of six different pictures can be formed).

Alternately, the picture display system comprises a series of equal sized cubes such that each cube has twelve side edges of equal width, each cube also having six faces such that the series of cubes is formed into a generally rectangular matrix, such that the matrix has an outer periphery. A banding frame encompasses the outer periphery of the matrix and cinches the matrix to hold the matrix together. A tongue having an opening extends outwardly from an outer surface of the banding frame. The banding frame is formed from a resilient material or from a rigid material. A magnetically attractive material may be disposed within each of the six faces of each of the cubes. At least some of the magnetically attractive material is a magnet.

BRIEF DESCRIPTION OF THE DRAWINGS

Similar reference numerals refer to similar parts throughout the several views of the drawings.

DESCRIPTION OF THE PREFERRED EMBODIMENT

Figure 1:
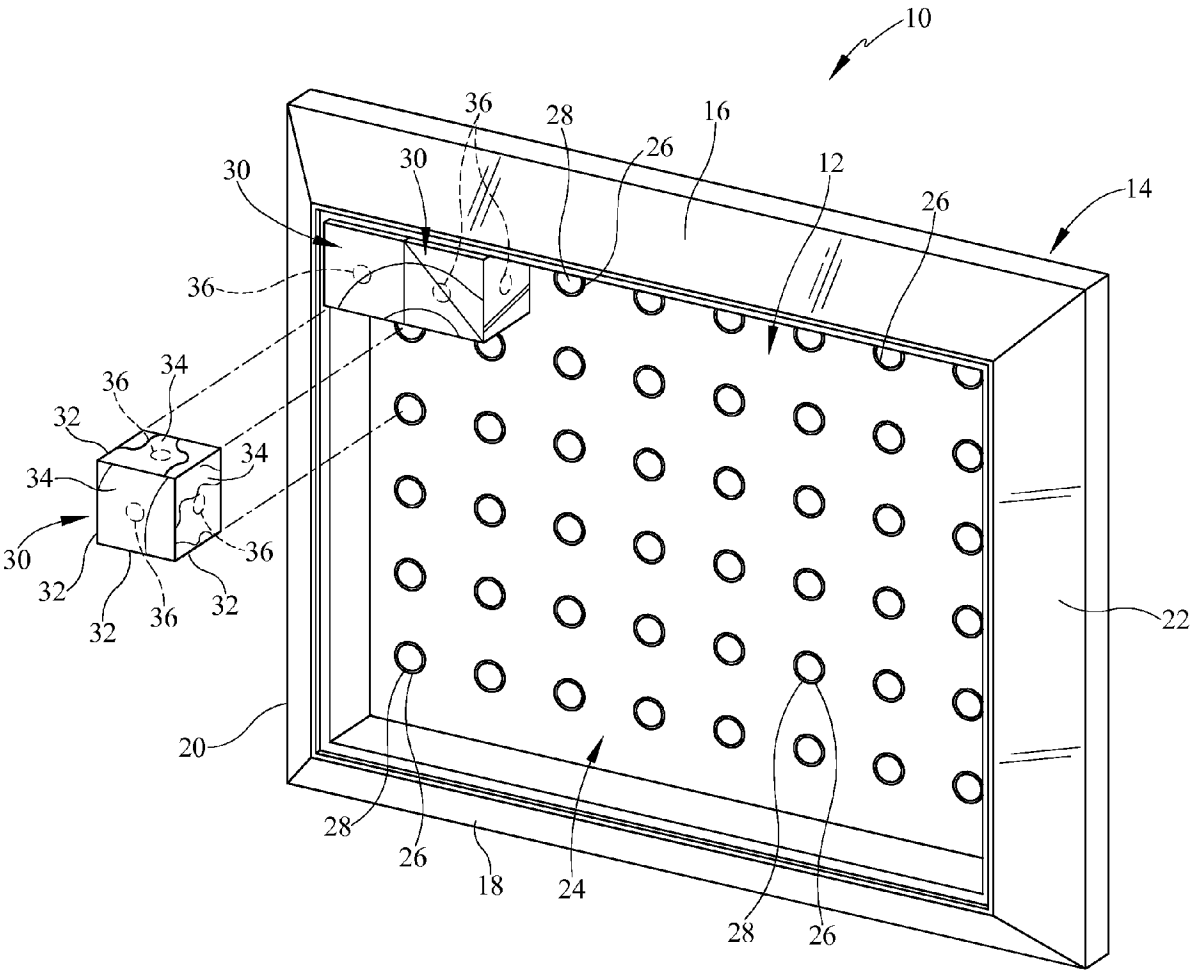
FIG. 1 is a perspective view of the cube display system of the present invention using a fixed frame.

Referring now to the drawings, it is seen that the cube display system of the present invention, generally denoted by reference numeral 10, is comprised of a base 12 with a substantially flat upper surface and an upwardly extending peripheral frame 14 that has a top edge 16 and a bottom edge 18, joined by left side edge 20 and a right side edge 22, the edges 16, 18, 20, and 22 forming an inner space 24, which inner space 24 is substantially rectangular in shape. A series of openings 26 are located within the base 12 and form an opening matrix as more fully described below. Encompassing each opening 26 and held within the frame 14 is a magnetically attractive material 28 that may be exposed to view or may be fully embedded within the base 12, although it is monolithic with the base 12 if the base 12 itself is formed from a magnetically attractive material. The base 12 and the frame 14 can each be made from any appropriate material, such as wood, plastic, metal, etc., and the edges 16, 18, 20, and 22 of the frame 14 can have any appropriate aesthetic design thereon, as desired.

A series of cubes 30 are provided such that each cube 30 has twelve side edges 32, all of equal length, and six faces 34. All of the cubes 30 are of uniform size. A portion of an overall pictorial representation is located on each face 34 of each cube 30, a different pictorial representation on each of the six faces 34 of each of the cubes 30. Each cube 30 can be made from any appropriate material such as wood, plastic, metal, etc. Each pictorial representation can be placed onto the surface 34 of the cube 30 in any appropriate manner known in the art such as being imprinted thereon in appropriate manner for the type of material used for the cube 30, can be printed onto a sticker (not illustrated) with the sticker adhered to the surface of each face 34 of the cube 30, etc. Of course, the pictorial representation need not be in the typical nature of a picture, but can be a solid color, such that each picture formed is simply a solid color block (especially useful for young children), or the picture can be formed via raised protrusions or indents on the face 34 of the cube 30.

Centrally disposed within each face 34 of the cube 30 is a second piece of magnetically attractive material 36 such as iron, nickel, etc. This piece of material 36 is advantageously disposed below the surface of the face 34—although it is monolithic with the cube 30 if the cube 30 itself is formed from a magnetically attractive material. At least one, possibly both of the first magnetically attractive material 28 and the second magnetically attractive material 36 is a magnet.

The inside length of the inner space 24 of the frame 14—the distance between the inner face of the left side edge 20 and the inner face of the right side edge 22—is substantially equal to an integer multiple of the length of the side edge 32 of a cube 30. Similarly, the inside height of the inner space 24 of the frame 14—the distance between the inner face of the top edge 16 and the inner face of the bottom edge 18—is substantially equal to an integer multiple of the length of the side edge 32 of a cube 30.

In order to use the cube display system 10 of the present invention, the cubes 30 are inserted into the frame 14 in rows and columns so that each cube 30 has the appropriate face 34 facing upwardly for the picture being represented and the cube 30 is placed into the appropriate row and column and rotated so that the cube 30 is in its proper position and orientation for the picture to be formed. The second piece of magnetically attractive material 36 is magnetically attracted to the first piece of magnetically attractive material 28 that encompassing each opening 26 in order to help hold the cube 30 in place even if the frame 14 is bumped or vertically rotated. Each cube 30 is so placed until the entire picture is formed by the matrix of cubes 30. As the inside length and width of the frame 14 are each an integer multiple of a cube length, when all of the cubes 30 are in place and the picture is complete, the cubes 30 are snugly held within the interior space of the frame 14. When the cubes 30 are in place, each cube 30 is atop one of the openings 26. Advantageously, although not necessarily, each opening 26 is roughly centered below its respective cube 30. The opening 26 is dimensioned to allow a user's finger, or at least a common tool such as a pencil (not illustrated), to be able to be inserted into the opening 26 from underneath the base 12 and into the interior space 24 of the frame 14 in order to be able to push the cube 30 that sits atop the particular opening 26 out of the matrix formed by the cubes 30, so that if the cube 30 is improperly oriented, either the improper face 34 is showing or the cube 30 may simply be improperly rotated, or if just some but not all of the cubes 30 are to have their faces 34 changed, or even the cube 30 is in the wrong position, then such cube 30 or cubes 30 can be pushed out of the cube matrix formed, reoriented, and placed back into position as desired without the need dump all of the cubes 30 out of the frame 14. The magnetic attraction between the first magnetically attractive material 28 and the second magnetically attractive material 36 is not so strong as to substantially inhibit the removal of a cube 30 from its position within the frame 14.

If the second magnetically attractive material 36 is a magnet, then if two cubes with the same magnetic pole orientation are placed next to each other—at least one is in the wrong position—then the magnets will repel one another giving an indication that at least one cube 30 is improperly positioned. Accordingly, the magnetic pole orientation of the magnets within each cube in a properly formed matrix alternate in a checkerboard pattern.

The device proper may simply be laid upon an appropriate surface, such as a coffee table (not illustrated), or can have an appropriate support (not illustrated) to allow the frame 14 to be positioned in an angled upright position. The base 12 may have appropriate hardware (not illustrated) to allow the device to be hanged from an appropriate surface such as a wall. A cover (not illustrated) can be removably placed atop the cube matrix to further help prevent cube 30 spillage should the device accidentally overturn. If a small poking tool is used to push through the openings 26 to dislodge a cube 30 from its matrix, then the tool can be tethered to the device to help prevent its loss.

Figure 2:
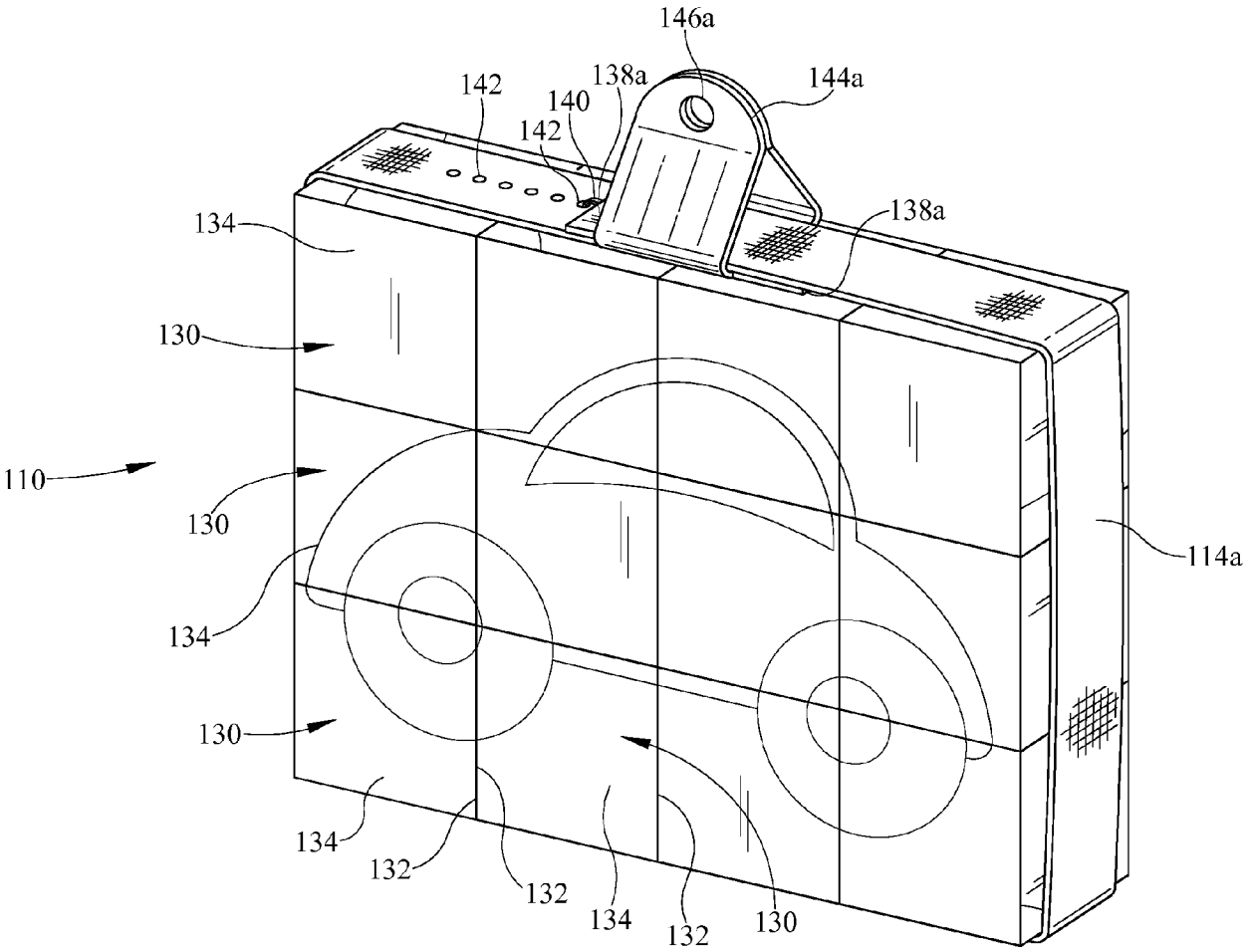
FIG. 2 is a perspective view of the cube display system using a flexible banding frame.
Figure 3:
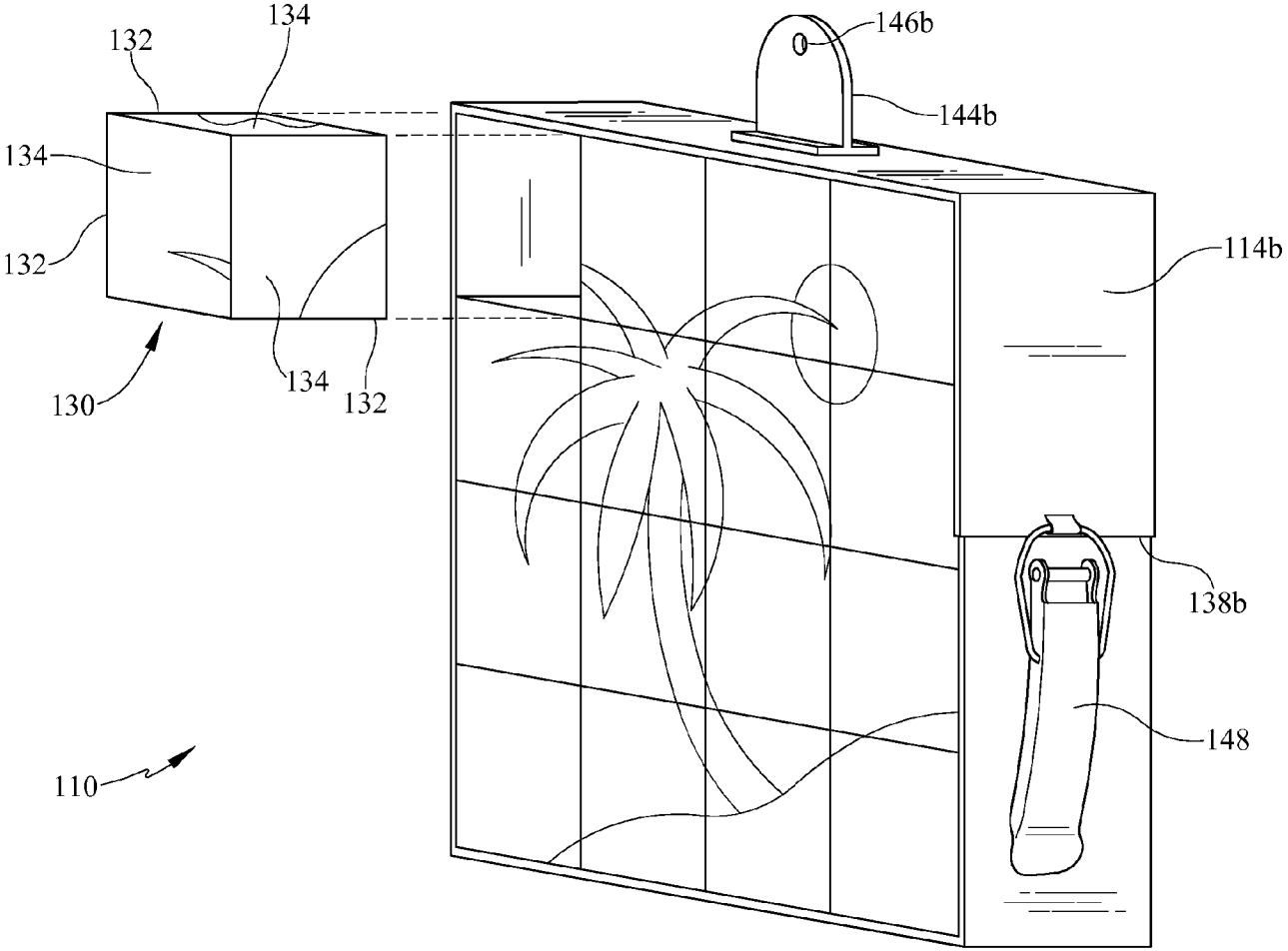
FIG. 3 is a perspective view of the cube display system using a rigid banding frame.

As seen in FIGS. 2 and 3, in an alternate embodiment of the cube display system 110, the cubes 130 are formed into their matrix without the initial use of a frame. The cubes 130 are substantially similar to the cubes 30 of the previous embodiment in that the cubes 130 each have twelve side edges 132, all of equal length, and have six faces 134. All of the cubes 130 are of uniform size. A portion of an overall pictorial representation is located on each face 134 of each cube 130, a different pictorial representation on each of the six faces 134 of each of the cubes 130. Each cube 130 can be made from any appropriate material such as wood, plastic, metal, etc. Each pictorial representation can be placed onto the surface 134 of the cube 130 in any appropriate manner known in the art such as being imprinted thereon in appropriate manner for the type of material used for the cube 130, can be printed onto a sticker (not illustrated) with the sticker adhered to the surface of each face 134 of the cube 130, etc.

In this embodiment of the cube display system 110, once the matrix is properly finished a banding frame encompasses the outer periphery of the completed matrix and is held tight to securely squeeze and hold the cubes 130 properly within the matrix. As seen in FIG. 2, the banding frame 114*a* is made from a relatively flexible material, such as leather, Nylon, cloth, etc. The two ends 138*a* of the frame 114*a* are secured to one another in appropriate fashion such as via the illustrated hook 140 located on one end 138*a* of the frame 114*a* that is removably received within one of the openings 142 located proximate the opposing end 138*a* of the frame 114*a*. Other securement means can also be used such as cooperating hook and loop material, etc. An upwardly extending tongue 144*a* having an opening 146*a* extends upwardly from the lower positioned end 138*a* of the frame 114*a* allowing the device to be hung from an appropriate hook, line, etc., for display of the matrix formed. As will be noted, in this embodiment, both the front of the formed matrix and the back of the formed matrix are visible so that two pictorial representations are capable of being displayed at a given time.

As seen in FIG. 3, the frame 114*b* is made from a relatively rigid material, such as aluminum, etc., with the ends 138*b* of the frame secured to one another in appropriate fashion such as via the illustrated latch system 148. Although the frame 114*b* is essentially rigid, the frame 114*b* has sufficient resiliency to be fitted over the completed matrix without disturbing the matrix and then cinched about the matrix. A tongue 144*b* having an opening 146*b* extends upwardly from one of the sides of the frame 114*b*, the tongue 144*b* being centrally located with respect to both length and width on the chosen side of the frame 114*b*.

In this embodiment of the cub display system 110, each face 134 of each cube 130 may have a magnet (not illustrated) centrally disposed therein, again the pole orientation being in a checkerboard pattern in a properly completed matrix of the cubes 130 which magnets help hold the completed matrix together via the magnetic attraction of the magnets—or the checkerboard pattern is formed with alternating magnets and non-magnet magnetically attractive material such as iron, nickel, etc.

While the invention has been particularly shown and described with reference to embodiments thereof, it will be appreciated by those skilled in the art that various changes in form and detail may be made without departing from the spirit and scope of the invention.

I claim:

1. A picture display system comprising:

a series of cubes such that each cube has twelve side edges of equal width, each cube also having six faces such that the series of cubes is formed into a generally rectangular matrix such that the matrix has an outer periphery; and a banding frame that encompasses the outer periphery of the matrix and cinches the matrix.

2. The picture display system as in claim 1 further comprising a tongue having an opening extending outwardly from an outer surface of the banding frame.

3. The picture display system as in claim 1 wherein the banding frame is formed from a resilient material.

4. The picture display system as in claim 1 wherein the banding frame is made from a rigid material.

5. The picture display system as in claim 1 wherein the banding frame is formed from either a resilient material or a rigid material.

6. The picture display system as in claim 1 further comprising a magnet disposed within each of the six faces of each of the cubes.

* * * * *